United States Patent [19]

Koenitzer et al.

[11] 4,239,817

[45] Dec. 16, 1980

[54] PROCESS AND APPARATUS FOR COATING ONE SIDE OF A METAL STRIP WITH MOLTEN METAL

[75] Inventors: Joachim Koenitzer; Heinrich Schmitz, both of Dinslaken; Kurt Jindra, Voerde, all of Fed. Rep. of Germany

[73] Assignee: Thyssen Aktiengesellschaft vorm. August Thyssen-Hütte, Duisburg, Fed. Rep. of Germany

[21] Appl. No.: 33,898

[22] Filed: Apr. 27, 1979

[51] Int. Cl.[3] ..... C23C 1/16

[52] U.S. Cl. ..... 427/211; 427/321; 427/428; 427/367; 118/249

[58] Field of Search ..... 118/248, 249, 250; 427/428, 211, 321; 220/218

[56] References Cited

U.S. PATENT DOCUMENTS

| | | | |
|---|---|---|---|
| 160,328 | 3/1875 | Jenkins | 118/249 |
| 896,751 | 8/1908 | Norton | 427/428 |
| 2,126,244 | 8/1938 | Cook et al. | 427/433 |
| 3,228,788 | 1/1966 | Teplitz | 427/428 |
| 4,082,868 | 4/1978 | Schnedler et al. | 427/434 A |
| 4,143,184 | 3/1979 | Paulus et al. | 427/321 |
| 4,172,911 | 10/1979 | Michels | 427/428 |

FOREIGN PATENT DOCUMENTS

| | | | |
|---|---|---|---|
| 2288792 | 5/1976 | France . | |
| 904485 | 8/1962 | United Kingdom | 427/433 |
| 905611 | 9/1962 | United Kingdom | 427/428 |
| 1004496 | 9/1965 | United Kingdom . | |
| 1040812 | 9/1966 | United Kingdom | 427/433 |

*Primary Examiner*—Ralph S. Kendall
*Attorney, Agent, or Firm*—J. Harold Nissen

[57] ABSTRACT

A process and apparatus for coating only one side of a metal strip with a molten metal, by continuously conveying a cleaned and heated strip of metal through a protective gas atmosphere above the level of a melting bath of the molten metal. The metal strip is supported on a reverse side thereof in the area of contact with the molten metal, and with the obverse side of the strip out of contact with the bath itself. The molten metal is conveyed by means of a scoop roller towards the supported area of the strip and only the scoop roller is immersed in the melting bath and only for a part of its surface area. The apparatus includes a container adapted to be filled with the molten metal to form the melting bath, a protective hood with a sluice type of inlet and outlet covering the container to maintain an atmosphere of protective gas thereover, and a supporting and deflection roller arranged under the hood above the level of the melting bath which cooperates with the scoop roller arranged below the supporting and deflection roller for together therewith conveying the metal strip through the melting bath. The scoop roller together with the supporting and deflection roller form an adjustable slot for the passage therethrough of the metal strip to be coated.

11 Claims, 1 Drawing Figure

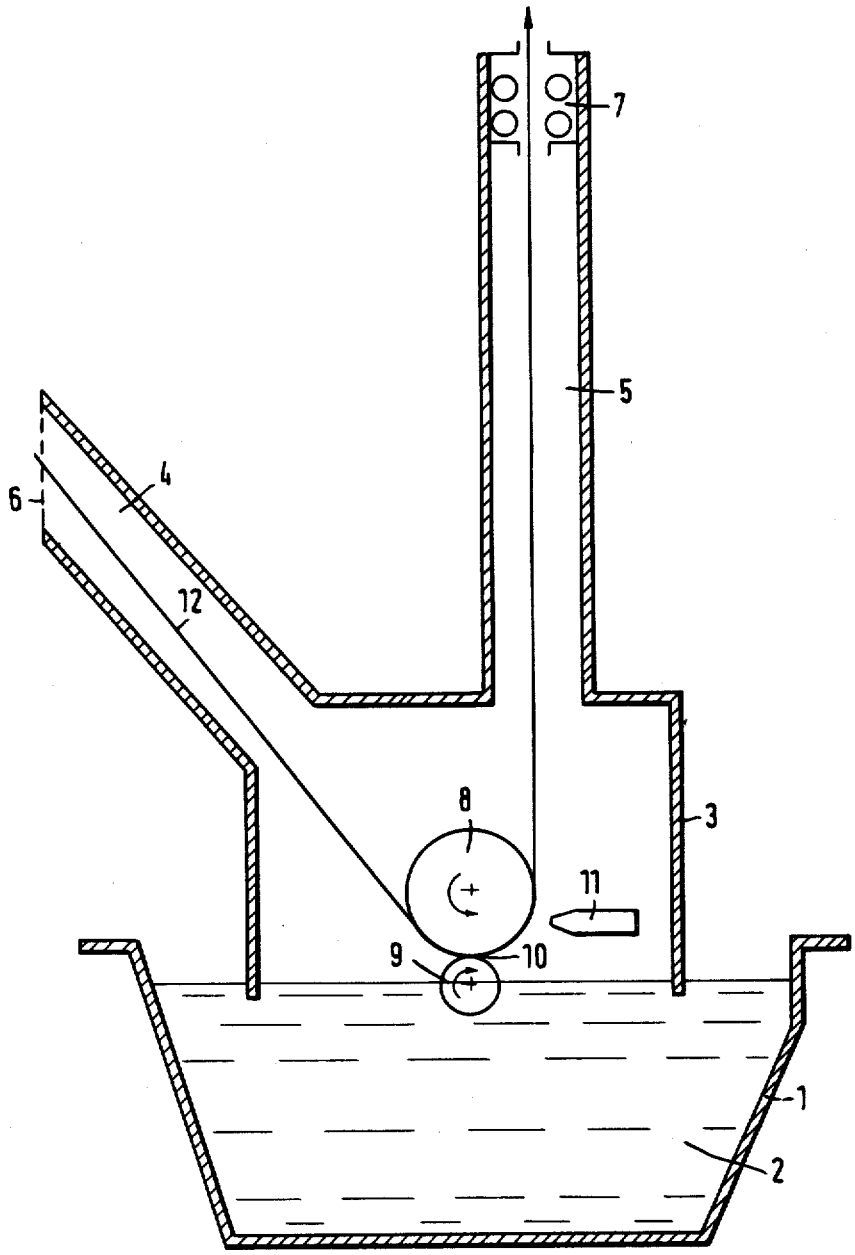
7
5
4
6
12
8
3
11
9
10
1
2

PROCESS AND APPARATUS FOR COATING ONE SIDE OF A METAL STRIP WITH MOLTEN METAL

BACKGROUND OF THE INVENTION

1. Field of the Invention

The invention relates to a process and an apparatus for coating a metal strip on one side with a molten metal.

More particularly, the invention is concerned with hot galvanizing a steel strip on one side thereof. Specifically, the strip is cleaned and heated, and the strip is then conveyed to a melting bath of the molten metal above the level of the melting bath in a protective gas atmosphere. An obverse side of the strip is continuously brought into contact with the molten metal while being maintained above the level of the molten bath, and it is supported on its reverse or rear side in the area of contact.

2. Description of the Prior Art

For some years specialists have been endeavoring to develop suitable processes, apparatuses and devices for coating a metal strip on one or the obverse side with a molten metal. The aim of these attempts is to obtain an even or uniform and an exactly adjustable thickness of layer on only one side. In addition, a process is required to prevent the molten metal from reaching the rear or reverse side of the strip during the coating.

In a known process of the above mentioned type, the metal strip is conveyed at a close proximity over the level of the melting bath, for example, by means of a supporting and deflection roller. Due to the surface tension of the molten metal, a meniscus of the molten metal is formed between the surface of the bath and the metal strip and, this meniscus is maintained with the short distance between metal strip and bath surface. In this way, the passing strip is continuously wetted with molten metal. The setting or determination of the thickness of the layer of coating is achieved by stripping the excess metal when still liquid by means of a connected jet knife (see, German Offenlegungsschrift No. 2,712,003).

However, the required layer thicknesses are only obtained with this adjustment of layer thickness when the preceding layer applied is applied evenly over the entire width of the strip. An even coating over the entire width of the strip can only be achieved when the distance between the level of the bath and the strip does not fluctuate. This requirement is difficult to achieve with a very short set distance, e.g. 10 mm. When the distance between the strip material and the level of the bath fluctuates, e.g. due to changes in the level of the bath, partial or complete breakup of the meniscus can result, or the molten metal can flow over the edges of the strip thus causing undesired coating of the rear or reverse side of the strip. There are several causes of fluctuations in the layer of the bath: consumption of the molten metal by the coating process, refilling of the molten metal, blasting of the bath surface by the blast jet from the jet knife. All these difficulties can hardly be eliminated even with exact guidance of the strip and a regulation plant for supervision of the level of the melting bath.

In another known process, deflection rollers are used. The strip which is to be coated is deflected 90° by two deflection rollers in each case and conveyed by them approximately parallel to the level of the melting bath at a considerable distance therefrom. The coating material is applied by means of a scoop roller immersed in the melting bath onto the strip in an unsupported area between the two deflection rollers. The desired thickness of layer is set by means of a squeeze-off roll running on the scoop roller (see U.S. Pat. No. 3,228,788).

It is indeed possible with this process and apparatus to coat the strip on only one side along its entire width without there being any danger of molten metal reaching the other side of the strip; however, adjustability of the thickness of layer is not exact enough with this process and apparatus in spite of the additional squeeze-off roll. Even a slight uneveness in the strip or movement of the strip radially to the scoop roller (shimmying) can result in an irregular contact between the strip and the scoop roller, and thus result in an uneven coating.

SUMMARY OF THE INVENTION

It is therefore an object of the invention to provide a process and an apparatus for coating a metal strip with molten metal which assures an even coating of the metal strip on only one side while at the same time providing for an exact adjustability within wide ranges.

The invention accomplishes the aforesaid object by providing a process and an apparatus for carrying out the process of the aforementioned type in which a scoop roller is used to convey the molten metal towards the supported area of the strip and by immersing the scoop roller in the melting bath only by part of its surface area.

In the process according to the invention exact geometric relationships are produced at the point of coating, with which the strip maintains its position and shape; and, the coating material is conveyed in a sufficient supply to the same point independent of fluctuations in the level of the bath. Although no additional means is provided for stripping off the excess molten metal, an exactly adjustable thickness of layer can be obtained even when the molten metal is conveyed in excess, since the metal strip squeezes off excess material due to the forced guidance of the molten metal. The thickness of layer can also be set exactly within wide limits depending on the forced guidance of the molten metal due to the scoop roller and the support of the metal strip; and, this is not only the case with large amounts to be applied. The thickness of layer can be set by adjusting the pressure.

The process according to the invention is particularly suitable for producing so-called galvanealed material; this is steel strip material, in which the molten zinc forms an alloy with the strip material. According to one embodiment of the invention, in which zinc is used as the molten metal and steel is used as the strip material, the molten metal has a temperature from 450° C. to 480° C., and the strip temperature amount is from 530° C. to 650° C., and in particular 570° C., and is restricted during application to the amount necessary to form an alloy with the strip material. In addition, the danger of overflowing the edges of the strip is eliminated by maintaining these ranges in temperature and thereby also maintaining a specific range of viscosity of the molten metal.

In this process, the lift or increase in temperature of the coating material necessary for the formation of the alloy is achieved because of the heat of the strip material. This is directly possible with the necessary low amounts of coating material to be applied. An advantage over the known processes consists in that the molten coating material does not need any ceramic container due to its low temperature. Note that, as the strip material is not directed through the melting bath itself, but only comes into contact with the melting bath indirectly, and the low application amount of molten coating material scooped is practically completely applied, i.e. no excess passes back into the melting bath, and the melting bath is practically not heated further. Neither is an additional connected furnace needed, as previously, to heat the strip material provided with the coating material to the temperature necessary for formation of the alloy. The strip material reaches the necessary temperature with the necessary annealing prior to the coating procedure. Then cooling is less intense than in the known previous process. With zinc as the coating material and steel as the strip material, temperatures between 450° C. and 480° C. have proved favorable for the melting bath and temperatures between 530° C. and 650° C. for the strip material are favorable.

The invention is also concerned with apparatus for carrying out the process of the invention and comprises a container which is filled with a molten metal and is covered by a protective hood to maintain an inert atmosphere. The protective hood has a sluice-type inlet and a sluice-type outlet for the metal strip to be coated. The apparatus also includes a supporting and deflection roller arranged above the level of the melting bath, and a scoop roller having only a part of its surface area immersed in the melting bath and arranged below the supporting and deflection roller. The scoop roller forms with the supporting and deflection roller an adjustable slot for the passage therebetween of the metal strip which is to be coated.

Preferably, the scoop roller and in particular the roll surface thereof is immersed in the melting bath by more than half of its surface area. It is possible with this embodiment of the invention to convey larger application amounts into the slot (formed between the supporting and deflecting roller and the scoop roller) without the scoop roller having its own drive means, since the liquid metal adhering to the scoop roller exerts considerably lower restoring moments onto the scoop roller than with a scoop roller which is only slightly immersed in the bath. Furthermore, in the case of a scoop roller, which is more than half immersed in the bath, there is lesser of a tendency for the molten metal to flow back into the bath than in the case of a scoop roller which is only slightly immersed.

It has been shown that with a scoop roller, which is immersed too deeply in the bath, there is a danger of the molten metal flowing over the edges of the strip and onto the reverse side of the strip. In order both to eliminate this danger and to apply the molten metal optimumly, the invention envisages that the scoop roller projects 10 to 45 mm, in particularly 10 to 15 mm, out of the melting bath.

In accordance with a further embodiment of the invention, the diameter of the supporting and deflection roller should be substantially larger than the diameter of the scoop roller, and in particular about double the size thereof. It is advantageous for the present invention, that the diameter of the scoop roller be relatively small, and in particular with a diameter of 150 to 350 mm, and preferably with a diameter of 250 mm.

Both the supporting and deflection roller and the scoop roller can be assembled to be freely rotatable. In this case, they are moved by the strip moving between them. In order to eliminate the danger of the roller coming to a standstill, the strip can be directed round the supporting and deflection roller at a large angle of contact.

If a particularly thick layer is required, not only is a correspondingly wide passage slot set between the scoop roller and the supporting and deflection roller, but also the scoop roller is immersed to a corresponding depth in the melting bath. It can also be of advantage here if the surface of the scoop roller in addition has a high bonding strength for the molten metal due to roughening or the like. Further, the supply of the molten metal into the passage slot can be influenced by the speed of the surface of the scoop roller being altered by means of a drive means driving one of the scoop rollers. If the speed of the surface of the scoop roller is greater than that of the strip, more molten metal is conveyed into the passage slot; if the speed of the surface of the scoop roller, however, is less than that of the strip, less molten metal is conveyed into the passage slot.

When the molten metal used is zinc, a substance which is non-soluble and/or non-wettable by the molten zinc can be used to prevent the molten zinc from evaporating. The substance can include a plurality of graphite balls covering the molten zinc in at least one layer, or a plurality of graphite balls, and a plurality of layers of the graphite balls to cover the molten zinc. The aforesaid features helps to improve the quality of the product produced. If vaporization of the zinc is not prevented, the zinc vapor condenses above the bath and drips as zinc dust onto the metal strip so that the surface of the uncoated metal becomes necessary to clean the strip. This zinc vapor can condense onto the hood and drop back as zinc dust. The graphite balls on the molten zinc helps to prevent the vaporization of the zinc.

Other objects, advantages and features of the invention will be readily understood from the following description with reference to the accompanying drawing illustrating the preferred embodiment of the present invention.

BRIEF DESCRIPTION OF THE FIGURE

The FIGURE is a schematic view of an apparatus for coating a metal strip with molten metal. The apparatus is shown in vertical longitudinal cross-section.

DESCRIPTION OF THE PREFERRED EMBODIMENT

Referring now more particularly to the single FIGURE of the drawing, container 1 is provided which is filled with a molten metal 2, e.g. zinc. A hood covering 3 having an open bottom is immersed in the melting bath 2 with its lower edge projecting thereinto. An inclined channel 4 and a vertical channel 5 feed into the covering hood 3. The channel 4 has a sluice-type inlet 6 and the channel 5 has a sluice-type outlet 7.

A supporting and deflection roller 8 is freely rotated above the level of the melting bath 2 and at a short distance therefrom. Positioned within the lower edges of the covering hood 3 when it is in placed with the edges thereof projecting into the melting bath is a scoop roller 9, which is substantially smaller in diameter than the supporting and deflection roller 8. Scoop roller 9 is arranged below the supporting and deflection roller 8, and the axis of the scoop roller 9 is arranged parallel to the axis of the supporting and deflection roller 8 and lies in the same vertical plane normal to the top of the melting bath. The scoop roller 9 is preferably immersed in the melting bath 2 by more than half its surface area.

The scoop roller 9 can be freely rotated or actuated by a conventional adjustable drive means, not shown. Between rollers 8 and 9, there is a wide passage slot 10 for passage therethrough of strip material 12 to be coated. A jet knife 11 is provided to blow a non-oxidizing gas onto the strip in order to finish it.

The strip material 12 which is to be coated runs over the sluice-type inlet 6, through the channel 4 into the area of the covering hood 3 which is under an atmosphere of protective gas. Here, the strip material 12 is deflected by the supporting and deflection roller 8 and passes vertically upwards through channel 5 and the sluice-type outlet 7. The strip material 12 loops the supporting and deflection roller 8 at an angle of about 135° C. Thereby, exact guidance is achieved at only a short distance from the level of the bath. The scoop roller 9, which touches the surface of the strip material 12, transports molten metal from container 1 into the passage slot 10 when the strip moves. The molten metal is applied with the desired thickness depending on the distance set between the two rollers 8,9. Excess metal is thereby squeezed off and flows back into the melting bath 2. Contrary to the known process of the German Offenlegungsschrift No. 2,712,003 and as an improvement thereover, however, the applied layer to the metal strip here can be set exactly independent of fluctuations in the level of the bath, as the molten metal is conveyed by the scoop roller to the surface of the strip which is fixed in position and thus constant relationships are ensured. The setting of the thickness of layer is also more exact than is the case with the other known process of the U.S. Pat. No. 3,228,788, as contrary thereto the application amount here is not metered before the area of application but at the area of application itself. This means that in the process according to the invention, high quality strip material can be produced with different thicknesses for the layer while maintaining very close tolerances. Maintaining close tolerances is not only of advantage for further processing but also means that considerable amounts of coating material are saved.

Although the thickness of layer can be set exactly with a low cost in apparatus in the process according to the invention, an adjustable jet knife 11 known per se can be additionally provided. Such jet knives 11 can be set at a height above the level of the melting bath, at a distance from the surface of the bath and at the angle at which the gas jet is blown onto the bath. It has proved particularly advantageous to arrange the jet knives at a height of 100 to 250 mm, in particular of about 150 mm, above the level of the melting bath. Since the coating is carried out under an atmosphere of protective gas, it is, of course, necessary also to operate the jet knives with a corresponding protective gas, e.g. nitrogen or argon.

Zinc coatings on a steel strip often show large areas of crystal patterns (flowers of zinc), which are particularly undesirable when the galvanized surface of the strip is placed on the visible side of a structural part. This flower formation can be prevented very simply and effectively by blowing a nucleus forming agent, e.g. zinc or zinc oxide dust, onto the zinc layer when still liquid together with the gas jet of the jet knives in accordance with a proposal of the invention.

In order to prevent the formation of zinc dust on the hood 3, so as to prevent the zinc dust from dropping onto the uncoated metal strip, a substance which is non-soluble and/or non-wettable by the molten zinc is floated onto the molten bath to keep the molten zinc from evaporating. The substance which has been found to be quite useful is graphite balls, and many particles of the graphite balls are usable to cover the molten zinc in one or several layers.

This improves the quality of the products formed, and if vaporization of the zinc is not prevented, the zinc vapor then condenses onto the hood 3 above the molten metal bath 2 and drops as zinc dust onto the metal strip 12 so that the surface of the uncoated metal strip becomes dirty, and therefore requiring a special cleaning of the strip 12.

While there has been shown what is considered to be the preferred embodiments of the invention, it will be obvious that various changes and modifications may be made therein without departing from the scope of the invention.

We claim:

1. A process for coating one side of a metal strip with a molten metal from a melting bath, comprising the steps of continuously conveying a previously cleaned and heated metal strip through a protective gas atmosphere partially around a supporting roller and above the level of the melting bath of the molten metal for bringing the metal strip into contact with the molten metal, supporting the metal strip on a rear or reverse side thereof on the supporting roller in the area of contact with the molten metal, and conveying the molten metal from the melting bath towards the supported area of the strip with a scoop roller immersed in the melting bath by more than half its surface area but only by part, which scoop roller together with the supporting roller forms an adjustable slot for the passage therebetween of the metal strip.

2. The process according to claim 1, wherein said molten metal is zinc and said metal strip is formed of steel.

3. The process according to claim 1 or 2, wherein the molten metal has a temperature between 450° C. to 480° C., and the temperature of the strip is between 530° C. and 650° C.

4. The process according to claim 3, wherein the strip temperature is 570° C. and the amount of the molten metal is restricted during application to the amount necessary to alloy with the strip material.

5. The process according to claim 1, wherein said molten metal is molten zinc and comprising the step of preventing said molten zinc from evaporating by using a substance which is non-soluble with the molten zinc.

6. The process according to claim 1, wherein said molten metal is zinc and comprising the steps of floating a substance on the top of the melting bath which is non-soluble and non-wettable by the molten zinc to prevent the molten zinc from evaporating.

7. The process according to claim 1, wherein said molten metal is zinc and comprising the steps of associating a substance with the melting bath which is non-wettable by the molten zinc to prevent the molten zinc from evaporating.

8. The process according to claim 5, 6 or 7, wherein said substance includes a plurality of graphite balls covering the molten zinc in at least one layer.

9. The process according to claim 5, 6 or 7 wherein said substance consists of a plurality of graphite balls, and a plurality of layers of said graphite balls covering the molten zinc.

10. The process according to claim 1, wherein said supporting step includes the step of supporting the obverse side of the metal strip above the level of the melting bath, and said conveying step includes the raising of the molten metal to the obverse side by said scoop roller.

11. The process according to claim 1 including the step of blowing a nucleus forming agent comprising a material selected from the group consisting of zinc and zinc oxide dust onto the metal coated strip.

* * * * *